United States Patent [19]

Pearson

[11] 3,980,328

[45] Sept. 14, 1976

[54] DOORBAR SYSTEM

[75] Inventor: Ernest A. Pearson, Pontiac, Mich.

[73] Assignee: Robert J. Pearson, Clarkston, Mich.

[22] Filed: May 21, 1975

[21] Appl. No.: 579,479

[52] U.S. Cl. ..... 292/256; 70/19; 220/315; 292/259 R; 292/260; 292/DIG. 24; 292/DIG. 53; 292/DIG. 54

[51] Int. Cl.[2] ..... E05B 13/00; E05C 13/02; E05C 19/18

[58] Field of Search ..... 292/259, 260, 289, 290, 292/256, 292–295, 338, 339, 347, DIG. 24, DIG. 67

[56] References Cited

UNITED STATES PATENTS

| | | | |
|---|---|---|---|
| 284,961 | 9/1883 | Hill | 292/259 |
| 327,373 | 9/1885 | Yarnall et al. | 292/259 |
| 390,130 | 9/1888 | Longenecker | 292/292 |
| 1,163,478 | 12/1915 | Snow | 292/338 |
| 2,331,150 | 10/1943 | Whiting | 292/289 X |

*Primary Examiner*—Casmir A. Nunberg
*Assistant Examiner*—Carl F. Pietruszka
*Attorney, Agent, or Firm*—William L. Fisher

[57] ABSTRACT

Improvement in a doorbar device for barring the door of a doorway, the doorway having doorjambs and a door therefor, the door having a doorknob, the doorbar device comprising a doorknob constructed to be affixed to the doorjambs of the doorway to extend across and bar the door from being opened, the doorbar device also comprising a mechanism for applying a force upon the doorknob to prevent turning thereof.

6 Claims, 5 Drawing Figures

DOORBAR SYSTEM

My invention relates to door bar systems for barring the door of a doorway.

The principal object of my invention is to provide improvements in doorbar devices and in a method of barring the door of a doorway, whereby to prevent burglaries, particularly in mobile homes.

The foregoing object of my invention and the advantages thereof will become apparent during the course of the following description, taken in conjunction with the accompanying drawings, in which.

Figure 2:
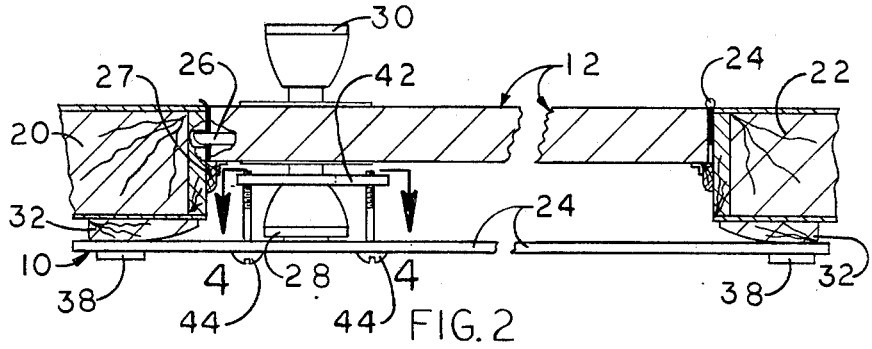
FIGS. 1 and 2 are, respectively, front elevational and horizontal sectional views of a doorbar device embodying my invention and shown in use barring a door.
Figure 4:
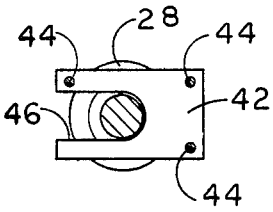
FIG. 4 is a horizontal sectional view of a portion of the structure of FIG. 2 taken on the line 4—4 thereof.
Figure 5:
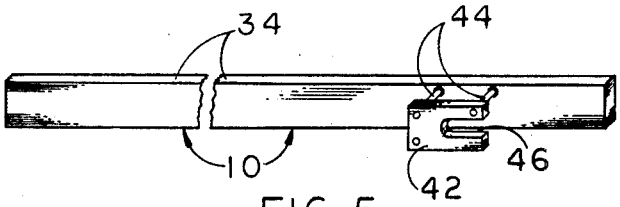
FIG. 5 is a perspective view from the rear of said embodiment.
Figure 3:
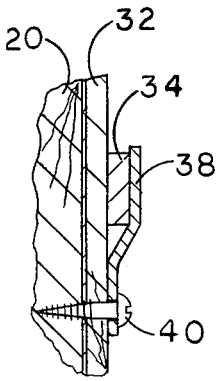
FIG. 3 is a vertical sectional view of a portion of the structure of FIG. 1 taken on the line 3—3 thereof.
Figure 1:
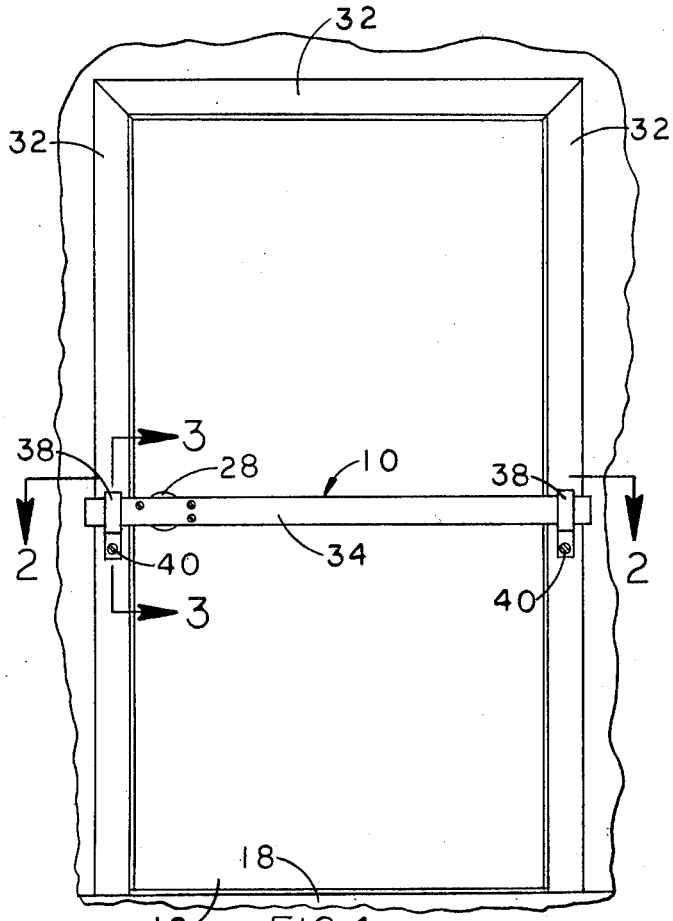

Referring to the drawings in greater detail, 10 generally designates said embodiment which is shown in use on a door 12 for a mobile home. Almost all mobile homes today are supplied with an auxilliary door 12 which while seldom used, is a big target for burglars because it is located on the rear wall of the mobile home and is the more easily broken into. Said door 12 is swingably mounted, as is usual, in a doorway, as shown, consisting of a lintel, a sill 18 and jambs 20 and 22 via hinges 24, on the jamb 22 and locked, via a lock mechanism 26 against the opposite jamb 20. Said lock mechanism 26 consists of inside and outside handles or doorknobs 28 and 30, respectively. Said door 12 closes against a stop 27. Said doorway 14 includes door mouldings 32 covering said lintel and door jambs.

Said doorbar device 10 comprises a doorbar 34 and a holding mechanism thereon for holding the door 12 from being opened. Said doorbar 34 is fastened to the doorway via brackets 38 and fasteners 40 therefor providing an upwardly opening horizontal pocket in which the doorbar 34 may be inserted from thereabove and held thereon. Said holding mechanism is fastened to the doorbar 34 and consists of a holding member 42 moveably fastened to said doorbar 34 by three fasteners 44 which extend through apertures in said doorbar 34 and threadably engage the holding member 42. Said holding member 42 is provided with a laterally open-ended slot 46 therein in which is inserted the shank of the doorknob 28. Said slot 46 forms upper and lower arms in one of which is provided a threadable aperture, as described, for threadably engaging the respective one of said fasteners 44. The other two fasteners 44 engage the body of said holding member 42 on the side thereof opposite said slot 46. Tightening of said fasteners 44 moves said holding member 42 toward the back face of the doorbar 34 so as to squeeze the doorknob 28 between said holding member 42 and said doorbar 34 to prevent turning of said doorknob 28 and hence also said doorknob 30. The doorbar device 10 is installed on the door 12 and doorway by first installing the brackets 38 on the jambs 20 and 22 and then inserting the doorbar 34 in the brackets 38 so that said holding mechanism engages said doorknob 28 as described. The holding mechanism is then tightened by tightening of the fasteners 44 to pull the holding member 42 against the doorknob 28 so as to squeeze the latter to prevent turning thereof and of the doorknob 30. With the doorbar device 10 installed on the door 12 and doorway as shown and described a would-be burglar will be thwarted in his attempted burglary since he cannot turn the doorknob 30 nor can be swing the door 12 open. The doorbar device 10 cannot be removed from the door 12 to allow use thereof without disturbing the brackets 38 by first loosening said fasteners 44 and then removing the doorbar 34 from the door 12.

It will thus be seen that there has been provided by my invention improvements in a doorbar device and in a method of barring the door of a doorway in which the object hereinabove set forth, together with many thoroughly practical advantages, has been successfully achieved. While a preferred embodiment of my invention has been shown and described, it is to be understood that variations and changes may be resorted to without departing from the spirit of my invention as defined by the appended claims.

What I claim is:

1. Improvement in a doorbar device for barring the door of a doorway, said doorway having doorjambs and a door therefor, said door having a doorknob, said doorbar device comprising a doorbar constructed to be affixed to the doorjambs of said doorway to extend across and bar the door from being opened, said doorbar device also comprising a mechanism for applying a force upon said doorknob to prevent turning thereof, said mechanism being carried on said doorbar for applying a squeezing force upon opposite faces of said doorknob.

2. Improvement as claimed in claim 1, said mechanism including a plate and fasteners operative upon said plate for pulling the same toward said doorbar to squeeze said doorknob between said plate and doorbar.

3. Improvement as claimed in claim 2, said plate having an open-ended slot therein to receive and accommodate the shank of said doorknob during use of said doorbar device, said fasteners being carried on said doorbar and threadably engaged with said plate.

4. Improvement in a method of barring the door of a doorway, said doorway having doorjambs and a door therefor, said door having a doorknob, said improvement comprising using the doorjambs of said doorway to fasten a doorbar across said door to bar the same from being opened and using said doorbar to apply a force on said doorknob to prevent the same from turning, said force applied to said doorknob being a squeezing force which squeezes upon opposite faces of said doorknob to prevent turning thereof, one face of said doorknob being squeezed against said doorbar.

5. Improvement as claimed in claim 4, holding a plate against a face of said doorknob, and pulling said plate toward said doorbar to squeeze said doorknob between said plate and said doorbar.

6. Improvement as claimed in claim 5, using fasteners to so pull said plate, said plate having an open-ended slot therein, receiving and accommodating the shank of said doorknob in said slot during use of said plate.

* * * * *